US008685610B2

(12) United States Patent
Golodetz et al.

(10) Patent No.: US 8,685,610 B2
(45) Date of Patent: Apr. 1, 2014

(54) IMAGE TRANSFER SYSTEM AND LIQUID TONER FOR USE THEREWITH

(75) Inventors: Galia Golodetz, Rehovot (IL); Benzion Landa, Nes-Ziona (IL); Yosef Cohen, Rehovot (IL); Ehud Chatow, Raanana (IL); Paul Fenster, Petach-Tikva (IL)

(73) Assignee: Hewlett-Packard Indigo B.V., Startbaan (NL)

( * ) Notice: Subject to any disclaimer, the term of this patent is extended or adjusted under 35 U.S.C. 154(b) by 732 days.

(21) Appl. No.: 12/417,538

(22) Filed: Apr. 2, 2009

(65) Prior Publication Data

US 2009/0253068 A1 Oct. 8, 2009

Related U.S. Application Data

(62) Division of application No. 10/502,879, filed on Apr. 27, 2005, now Pat. No. 7,517,622.

(51) Int. Cl.
*G03G 9/13* (2006.01)

(52) U.S. Cl.
CPC ..... *G03G 9/133* (2013.01); *G03G 9/131* (2013.01)
USPC ..... 430/114; 430/112; 430/115; 430/116

(58) Field of Classification Search
USPC ..... 430/112, 114, 115, 116
See application file for complete search history.

(56) References Cited

U.S. PATENT DOCUMENTS

| | | | |
|---|---|---|---|
| 4,935,788 A | 6/1990 | Fantuzzo et al. | |
| 5,422,366 A | 6/1995 | Mintzis et al. | |
| 5,747,057 A | 5/1998 | Miller | |
| 6,391,507 B1 | 5/2002 | Macholdt et al. | |
| 2002/0172880 A1 * | 11/2002 | Takayanagi et al. | 430/108.23 |

FOREIGN PATENT DOCUMENTS

| | | |
|---|---|---|
| EP | 1124165 | 8/2001 |
| EP | 1124165 A1 | 8/2001 |
| GB | 1035837 | 7/1966 |
| GB | 1303871 | 1/1973 |
| WO | 9205476 | 4/1992 |

OTHER PUBLICATIONS

International Search Report for PCT/IL02/00090 dated Oct. 29, 2002.

* cited by examiner

*Primary Examiner* — Peter Vajda

(57) ABSTRACT

A printing method comprising: forming a first image utilizing a liquid toner comprising carrier liquid and pigmented polymer particles having a first color; transferring the first image to an intermediate transfer member; forming at least one additional image utilizing a liquid toner comprising at least one carrier liquid and pigmented polymer particles having a second color, different from the first color; transferring the at least one additional image to the intermediate transfer member overlaid on the first image, to form a composite image on the intermediate transfer member; and further transferring the composite image to a further substrate, wherein said polymer particles in said first liquid toner and in at least one of said additional liquid toners have different compositions, aside from colorants, the differences in composition including at least one of different polymers or blends of polymers, different amounts or types of placticizers, different amounts of solvated liquid and different compositions of solvated liquid.

44 Claims, 3 Drawing Sheets

IMAGE TRANSFER SYSTEM AND LIQUID TONER FOR USE THEREWITH

The present application is a divisional of U.S. application Ser. No. 10/502,879, filed on Apr. 27, 2005, now U.S. Pat. No. 7,517,622.

FIELD OF THE INVENTION

The present invention is related to the field of liquid toner printing systems and in particular to multicolor printing systems.

BACKGROUND OF THE INVENTION

Liquid toner printing systems are well known. Some of such systems, utilize an intermediate transfer member. The intermediate transfer member receives a developed liquid toner image from an image forming member ("first transfer"), such as a photoreceptor, and transfers the image to a final substrate (second transfer). Such systems are designated herein as "liquid toner offset printing systems." As used herein, the term printer includes copiers or other machines in which the final product is a printed image on a substrate.

Two methodologies are used when multi-color images are to be printed. Both require the generation of multiple separations (i.e., single color partial images) that, when superimposed, result in the desired printed image. Each of said images is separately generated on the image forming member, transferred to the intermediate transfer member and transferred therefrom to the final substrate. In some systems, the images are separately transferred to the final substrate. In these systems, the images are separate on the intermediate transfer member and are superimposed in registration, on the final substrate. In other systems, referred to herein as "one-shot" systems, the images are separately formed on the image forming member and are transferred to the intermediate transfer member in registration and superposition thereon. The superposed images are transferred together to the final substrate.

In some one shot systems, a same image forming member is used to generate the separations sequentially. In other systems a plurality of image forming systems are present, each of which generates an image of a different color, the plurality of images being superimposed on the intermediate transfer member.

Toner systems for printing liquid toner images are also well known and have a long history. In modern liquid toner printing, the toner is based on a composition that includes a carrier liquid and (generally charged) colored (generally pigmented) polymer based toner particles. Exemplary examples of such toners are described in U.S. Pat. Nos. 6,155,457; 6,146,803; 5,972,548; 5,923,929; 5,554,476; 5,426,491; 5,407,771; 5,346,796; 5,286,593; 5,264,313; 5,266,435; 5,231,454; 5,208,130; 5,108,866; 5,048,762; 5,047,306; 4,966,824; 4,794,651; 4,794,651; 4,756,986; 4,719,026; 4,582,774; PCT publications WO 96/31808; WO 99/45433; WO 96/13760; WO 01/53895 and WO 01/88619, the disclosures of all of which am incorporated herein by reference.

In general, the various differently colored toners in a set of toners used to print a given image have a same basic structure, namely, that the polymer used as the basis for the toner particles is the same for the entire set.

SUMMARY OF THE INVENTION

In general, in one-shot printing, the first partial image (separation) transferred to an image transfer member remains on the image transfer member for a longer time than do the separations that are transferred later. Since in most systems, the intermediate transfer member is heated, significantly more of the carrier liquid within the earlier transferred separations is evaporated before second transfer. This changes the rheology, tackiness and cohesiveness of the image and, in some cases may result in poor second transfer of some or all of the separations and/or in different amounts and quality of transfer for the different separations. This phenomenon may or may not occur, depending on the particular polymer used, the dwell time of the separations on the intermediate transfer member, the composition of the carrier liquid, the temperature of the intermediate transfer member and other factors. Since the rheology of the toner is partially dependent on the pigments used, this phenomenon may also depend on the pigments used and, for a given set of toners, on the order of printing of the separations.

In an aspect of some embodiments of the invention, a method is provided for design and manufacture of sets of toner of colors suitable for printing full color images.

In some embodiments of the invention, a set of liquid toners is provided, in which the toner properties are adjusted to reduce the effects of differing dwell times (on the intermediate transfer member) on the physical properties of the various toner image separations.

In an embodiment of the invention, the properties, for example those described herein as effecting transfer of liquid toner separations, of various toner materials, under conditions of dwell on an intermediate transfer member, are determined or estimated. Based on this determination or on experimental results, the properties of one or more of the various toners in a set of colored toners are adjusted to improve the second transfer of the separations. In some embodiments of the invention, the spread in such properties caused by unequal dwell times for the separations or by the effects of different pigments or pigment loadings used in the various toners is compensated for such that the toners have a smaller spread of properties on second transfer. Such a smaller spread in properties will generally lead to a wider operating window.

A general aspect of some embodiments of the invention is concerned with the use of toners having different characteristics (other than color), for example, rheology, tackiness and/or cohesiveness, for at least some of the different colored liquid toners used in a set of liquid toners. In some embodiments, different polymers for at least some of the different colored liquid toners used. In others, different carrier liquids are use. In yet others, plasticizers (additional to the carrier liquid), added to some of the colored toners and not to others or are used in different amounts in different ones of the toners. Additionally, in some of the embodiments of the invention a different plasticizing liquid is used in producing plasticized polymer which forms the base from which the toner particles is formed.

In an exemplary embodiment of the invention, different polymers or different blend ratios of polymers are used as the basis for the pigment particles in at least some of the liquid toner that make up a set of toners for printing. In general, a set of toners is made up of cyan, magenta and yellow, with optional black, orange, violet and/or green toners. While only the first three colors are generally required, richer and or deeper colors and blacks may be possible if more colors are used.

In many of the liquid toners used today, the toner particles are formed by grinding a polymer that has been plasticized with a liquid, such as a liquid hydrocarbon, that is solvated by the polymer. In some embodiments of the invention the liquid used to pre-plasticize the polymer is different from that used as the carrier liquid for the liquid toner. The amount of the liquid that is absorbed by the polymer is believed to play a role in the ability of the earlier produced images to undergo good second transfer. In particular, the present inventors have found that polymers which solvate a greater amount of liquid apparently also hold liquid longer to a greater degree. Such toner polymers are thus suitable for use as polymers for earlier transferred separations.

In some embodiments of the invention, only a portion of the polymer, which forms the basis for the later separations, is replaced by the polymer having the higher carrier liquid holding capacity. The present inventors have found that that it is sufficient, in some embodiments, for only a portion of the polymer to be replaced. At least some of the polymers having the higher holding capacity for carrier liquid also have a higher melt index than at least some of the polymer used in the past as standard materials. In general, materials with a higher melt index have a higher gloss.

In some embodiments of the invention, the liquid toner in the earlier printed separation or separations have a different chemistry than those in the later printed separations. In some embodiments, the different chemistry comprises a different chemistry of the toner particles with respect to the carrier liquid.

Alternatively or additionally, the first transferred layers utilize a polymer to which a rheology (or other relevant property) adjusting additive, such as a plasticizer, has been added. Such an additive may reduce the viscosity of the toner to a sufficient degree that the toner has an acceptable rheology even with less solvated carrier liquid.

There is thus provided, in accordance with an exemplary embodiment of the invention, a printing method comprising:

forming a first image utilizing a liquid toner comprising carrier liquid and pigmented polymer particles having a first color;

transferring the first image to an intermediate transfer member;

forming at least one additional image utilizing a liquid toner comprising at least one carrier liquid and pigmented polymer particles having a second color, different from the first color;

transferring the at least one additional image to the intermediate transfer member overlaid on the first image, to form a composite image on the intermediate transfer member; and further transferring the composite image to a further substrate, wherein said polymer particles in said first liquid toner and in at least one of said additional liquid toners have different compositions, aside from colorants, the differences in composition including at least one of different polymers or blends of polymers, different amounts or types of placticizers, different amounts of solvated liquid and different compositions of solvated liquid.

In an embodiment of the invention, a substantially larger portion of the carrier liquid in said first toner image and in said at least one additional toner image are evaporated while said respective images are on the intermediate transfer member, said evaporation changing one or more of the rheology, tackiness or cohesiveness characteristics of the respective image, such that said one or more characteristic is substantially more similar when said images are further transferred from the intermediate transfer member than when they are transferred to the intermediate transfer member.

In an embodiment of the invention, the carrier liquid is a liquid hydrocarbon. In an embodiment of the invention, the solvated liquid is a liquid hydrocarbon. Optionally, the carrier liquid is the same as the solvated liquid. Alternatively, the carrier liquid is not the same as the solvated liquid.

In an embodiment of the invention, the intermediate transfer member is at an elevated temperature and wherein said first and at least one additional liquid toners in said images, as transferred to the intermediate transfer member, have different characteristics of tackiness, rheology or cohesiveness at said elevated temperature.

Optionally, the first and at least one additional liquid toners have substantially similar characteristics at 25° C.

Optionally, the polymer particles pigmented polymer particles solvate said carrier liquid in said first and at least one additional liquid toner at said elevated temperature.

In an embodiment of the invention, at least said first liquid toner comprises a plasticizer for said toner particles, said plasticizer being additional to or different from in amount or type from any plasticizer that may be present in said at least one additional liquid toner. Optionally, the plasticizer comprises one or more of Di Butyl phtalate, Acetyl triethyl citrate or Acetyl tri-butyl citrate.

In an embodiment of the invention, the polymer particles in said first liquid toner comprise a different polymer or mixture of polymers than do the polymer particles in said at least one additional toner. Optionally, the polymers in the particles of the different toners are different. Alternatively or additionally, the polymers are different in that the polymer of one of the particles is formed of a mixture of polymers said mixture comprising a polymer comprised in the other particles and at least one additional polymer not comprised in the one particle. Alternatively or additionally, the polymers are different in that the polymer of the particles are formed of a mixture of polymers the proportion of polymers in said mixture being different for the respective particles. Optionally, one of the polymers is an ethylene acid/methacrylic acid copolymer. Alternatively or additionally, one of the polymers is an Acid-Modified Ethylene Acrylate. Alternatively or additionally, one of the polymers is an ethylene acrylic acid copolymer.

In an embodiment of the invention, the polymer particles are formed in a process in which the polymer of the particles is heated with and plasticized by a liquid, some of which remains solvated by the polymer after cooling the particles and wherein the proportionate amount or composition of said remaining solvated liquid is different for the particles in the first and at least one additional toner. Optionally, the proportionate amount is different. Optionally, the proportion by weight of liquid in the first toner particles is over 30% or 35% by weight of polymer. Optionally, the proportion by weight of liquid in the toner particles of at least one additional toner is less than 30% or 25% by weight of polymer. Optionally, the composition of the remaining solvated liquid is different.

Optionally, the liquid solvated in the toner particles of the first toner comprises liquid having an evaporation time compared to Diethylether of more than 150.

Optionally, the liquid solvated in the toner particles of at least one additional toner comprises liquid having an evaporation time compared to Diethylether or greater than 250.

Optionally, the ratio of evaporation rates of the liquids solvated in the first and second toner particles is at least 2:1, 3:1 or 4:1.

In an embodiment of the invention, the carrier liquid used in said first and at least one additional toner is different or comprises a mixture of different carrier liquids or a mixture of the same carrier liquids in different proportions.

In an embodiment of the invention, the toner particles are charged.

In an embodiment of the invention, forming an image comprises:

forming a latent electrostatic image on an image forming surface;

contacting the image with a liquid toner to form a visible image.

Optionally, the liquid toners comprise at least cyan, magenta and yellow toners. Optionally, the liquid toners comprise a black toner. Optionally, the liquid toners comprise one or more of violet, orange and green toners.

There is further provided, in accordance with an exemplary embodiment of the invention a set of at least two liquid toners for printing multi-color images, each said toner having a different color, each said toner comprising:

a carrier liquid, toner particles comprising a pigmented polymer of a given color, different from the color of pigmented particles in other toners in the set, wherein said polymer particles in a first liquid toner of said set and in at least one of the other liquid toners have different compositions, aside from colorants, the differences in composition including at least one of different polymers or blends of polymers, different amounts or types of placticizers, different amounts of solvated liquid and different compositions of solvated liquid.

In an embodiment of the invention, the carrier liquid is a liquid hydrocarbon. In an embodiment of the invention, the solvated liquid is a liquid hydrocarbon. Optionally, the carrier liquid is the same as the solvated liquid. Alternatively, the carrier liquid is not the same as the solvated liquid.

In an embodiment of the invention, the first and at least one additional liquid toners have substantially similar characteristics at 25° C.

Optionally, the polymer particles pigmented polymer particles solvate said carrier liquid in said first and at least one additional liquid toner at 75° C.

In an embodiment of the invention, at least said first liquid toner comprises a plasticizer for said toner particles, said plasticizer being additional to or different from in amount or type from any plasticizer that may be present in said at least one additional liquid toner. Optionally, the plasticizer comprises one or more of Di Butyl phtalate, Acetyl tri-ethyl cite and Acetyl tri-butyl citrate.

In an embodiment of the invention, the polymer particles in said first liquid toner comprise a different polymer or mixture of polymers than do the polymer particles in said at least one additional toner. Optionally, the polymers are different. Optionally, the polymers are different in that the polymer of one of the particles is formed of a mixture of polymers said mixture comprising a polymer comprised in the other particles and at least one additional polymer not comprised in the one particle. Optionally, the polymers are different in that the polymer of the particles are formed of a mixture of polymers the proportion of polymers in said mixture being different for the respective particles. Optionally, one of the polymers is an ethylene acid/methacrylic acid copolymer. Optionally, one of the polymers is an Acid-Modified Ethylene Acrylate. Optionally, one of the polymers is an ethylene acrylic acid copolymer.

In an embodiment of the invention, the polymer particles are formed in a process in which the polymer of the particles is heated with and plasticized by a liquid, some of which remains solvated by the polymer after cooling the particles and wherein the proportionate amount or composition of said remaining solvated liquid is different for the particles in the first and at least one additional toner. Optionally, the proportionate amount is different. Optionally, the proportion by weight of liquid in the first toner particles is over 30% or 35% by weight of polymer. Optionally, the proportion by weight of liquid in the toner particles of at least one additional toner is less than 30% or 25% by weight of polymer. Optionally, the composition is different.

In an embodiment of the invention, the liquid solvated in the toner particles of the first toner comprises liquid having an evaporation time compared to Diethylether of more than 150 or 250. Optionally, the liquid solvated in the toner particles of at least one additional toner comprises liquid having an evaporation time compared to Diethylether of less than 150.

In an embodiment of the invention, the ratio of evaporation times of the liquids solvated in the first and second toner particles is at least 2:1, 3:1 or 4:1.

In an embodiment of the invention, the carrier liquid used in said first and at least one additional toner is different or comprises a mixture of different carrier liquids or a mixture of the same carrier liquids in different proportions.

In an embodiment of the invention, the toner particles in said first and at least one other liquid toners have different characteristics including at least one of rheology, tackiness and cohesiveness, for at least some of the different colored liquid toners in the set of liquid toners. Optionally, said toners have said different characteristics at elevated temperatures.

Optionally, the polymer particles solvate said carrier liquid at elevated temperatures, suitable for fusing and fixing the toner to a substrate. Optionally, a first liquid toner at a first, higher solids concentration has substantially the same characteristic as another liquid toner of the set at a second lower solids concentration at an elevated temperature at which the toner particles solvate the carrier liquid.

In an embodiment of the invention, the carrier liquid is different for at least two liquid toners of the set of liquid toners. Optionally, the carrier liquid in a first member of the set comprises a first carrier liquid component not present in at least one other liquid toner of the set, said first carrier liquid component having a slower evaporation at high temperatures than carrier liquid components present in both liquid toners. Optionally, the carrier liquid in a first member of the set comprises a first carrier liquid component present in at least one other liquid toner of the set in a higher proportion than in at least one other liquid toner of the set, said first carrier liquid component having a slower evaporation at high temperatures than other carrier liquid components present in both liquid toners.

In an embodiment of the invention, the liquid toners comprise at least cyan, magenta and yellow toners. Optionally, the liquid toners comprise a black toner. Optionally, the liquid toners comprise one or more of violet, orange and green toners.

There is further provided, in accordance with an exemplary embodiment of the invention, a method of producing at least two members of a set of differently colored liquid toners comprising:

for each of the members, heating a polymer material with a hydrocarbon liquid by which the polymer material is plasticized; and forming pigmented toner particles, based on the plasticized polymer material for each of the toners, wherein some of the hydrocarbon liquid remains solvated by the polymer after cooling the particles and wherein the proportionate amount or composition of said remaining solvated hydrocarbon liquid is different for the particles in the at least two members of the set.

BRIEF DESCRIPTION OF THE DRAWINGS

Exemplary, non-limiting, embodiments of the invention are described with reference to the appended drawings, in which.

DETAILED DESCRIPTION OF EXEMPLARY EMBODIMENTS

Figure 1:
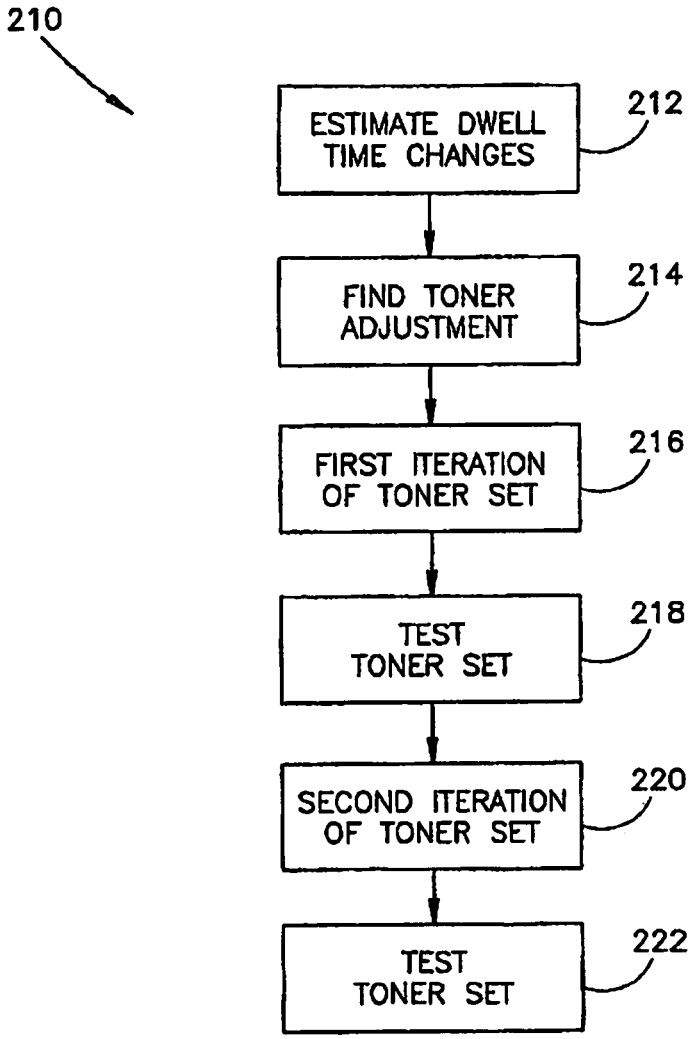
FIG. 1 shows a methodology for the design and production of toners for one shot printing with reduced variation at second transfer.

FIG. 1 shows a simplified flow chart 210, for the design and adjustment of a set of toners for use in a one shot printing system, in accordance with an exemplary embodiment of the invention.

At 212 an estimate is made of the changes in the rheology of the toner as a function of dwell time. This estimate is a function of the type of polymer or polymer blend used as the basis for the toner particles. It is also a function of the temperature of the intermediate transfer member and of the type of carrier liquid used in the toner. It is also a function of the liquid used to solvate the polymer. Finally, it is a function of additives that are added to the toner particles that adjust the rheology of the toner at second transfer.

The starting point for the process is often a toner that has good second transfer for a given dwell time, intermediate transfer member temperature and other operating conditions of the printer. The exact physical properties of the toner material need not be known, however, in an embodiment of the invention, the properties of the other toners are adjusted to provide similar properties. It is useful to consider the toner having the lowest dwell time as having the "goal" properties, although the toner used for other separations can be used to define the goal.

Thus, at 214 a first adjustment for one or more of the other toners is determined. Any of the methodologies described below may be used to compensate for the increased dwell time of the other (than the "goal") toners.

At 216, a first iteration for a set of toners is determined. In many cases, this iteration, based on a very general knowledge of the effects of various changes in the composition of the toner will give an improved set of toners that need not be further adjusted.

At 218, the set of toners is optionally tested by printing test separations. The quality of the images is determined for example, by measurement and other tests such as adhesion, known in the art. In an embodiment of the invention, the printer characteristics are varied to determine the operating window of the set of toners. For example the temperature of the intermediate transfer member and/or the first and/or second transfer pressure, and/or the first transfer voltage and/or development parameters are used to determine the size of the operating window.

A second, optional, iteration 220 and a second set of tests 222 may be performed in which those toners that restrict the operating window are further adjusted and tested, in accordance with the changes in the toner characteristics that are described below. In general, a major cause of variation in second transfer between the separations is the amount of liquid remaining in (and solvating) the image. Methods for adjusting this amount of liquid by changing the polymers (and blends) used, changing the liquid used to solvate the polymer in the formation of the toner and adding plasticizer, are described below. Other characteristics that may effect the transfer may be adjusted similarly. Further iterations may also be performed.

In order to speed up the convergence of the iterative process, tests may be made to characterize the toner properties under conditions of varied dwell as a function of the below-described adjustments in the toner. While such iteration is desirable, it is not necessary for achieving improved results, based on present knowledge of the functions and effects of the variations of the toner constitution described herein. However, such iteration may be required to produce optimal toner sets.

Figure 2:
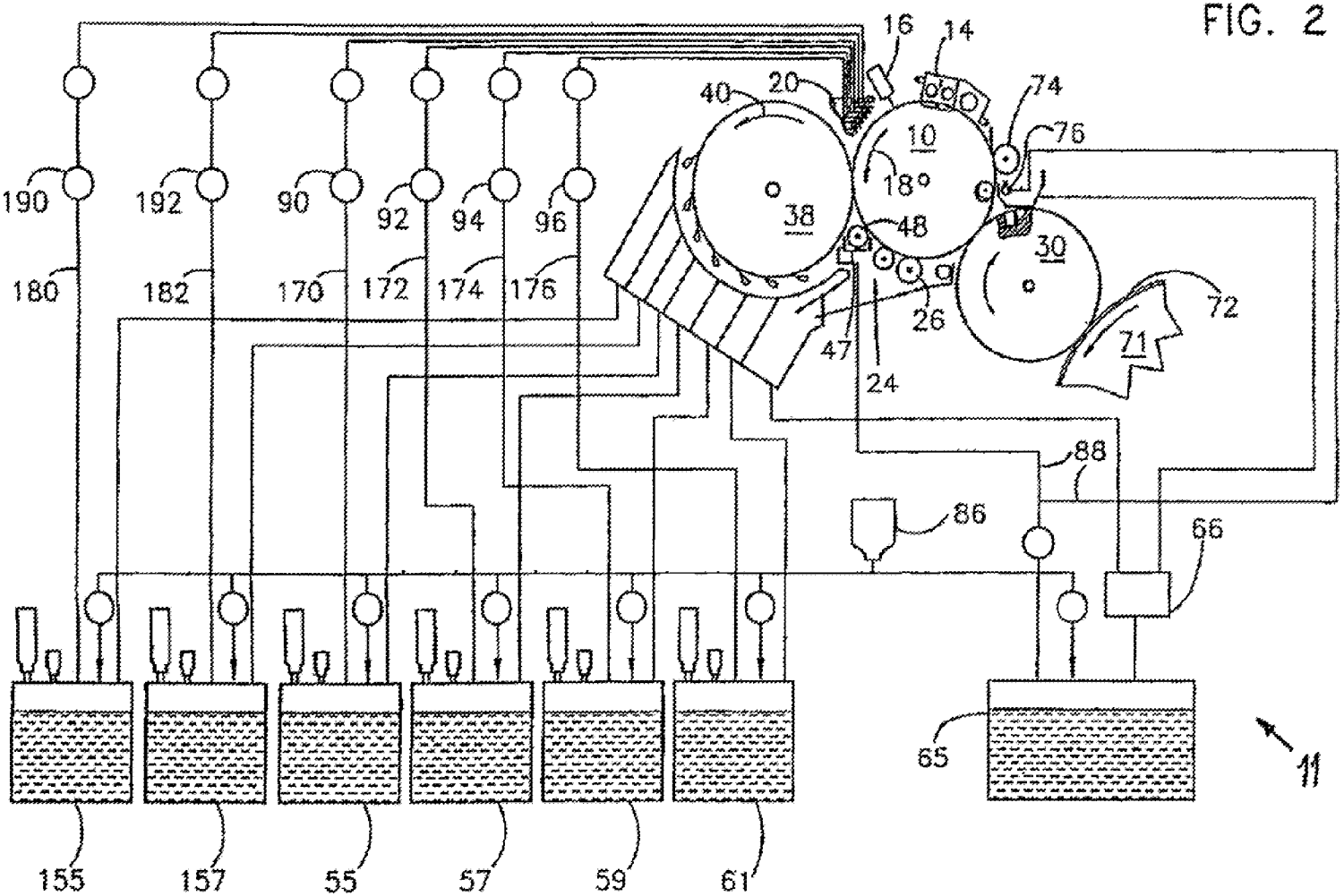
FIGS. 2 and 3 show a simplified schematic exposition of an exemplary one-shot printing system in accordance with an exemplary embodiment of the invention.
Figure 3:
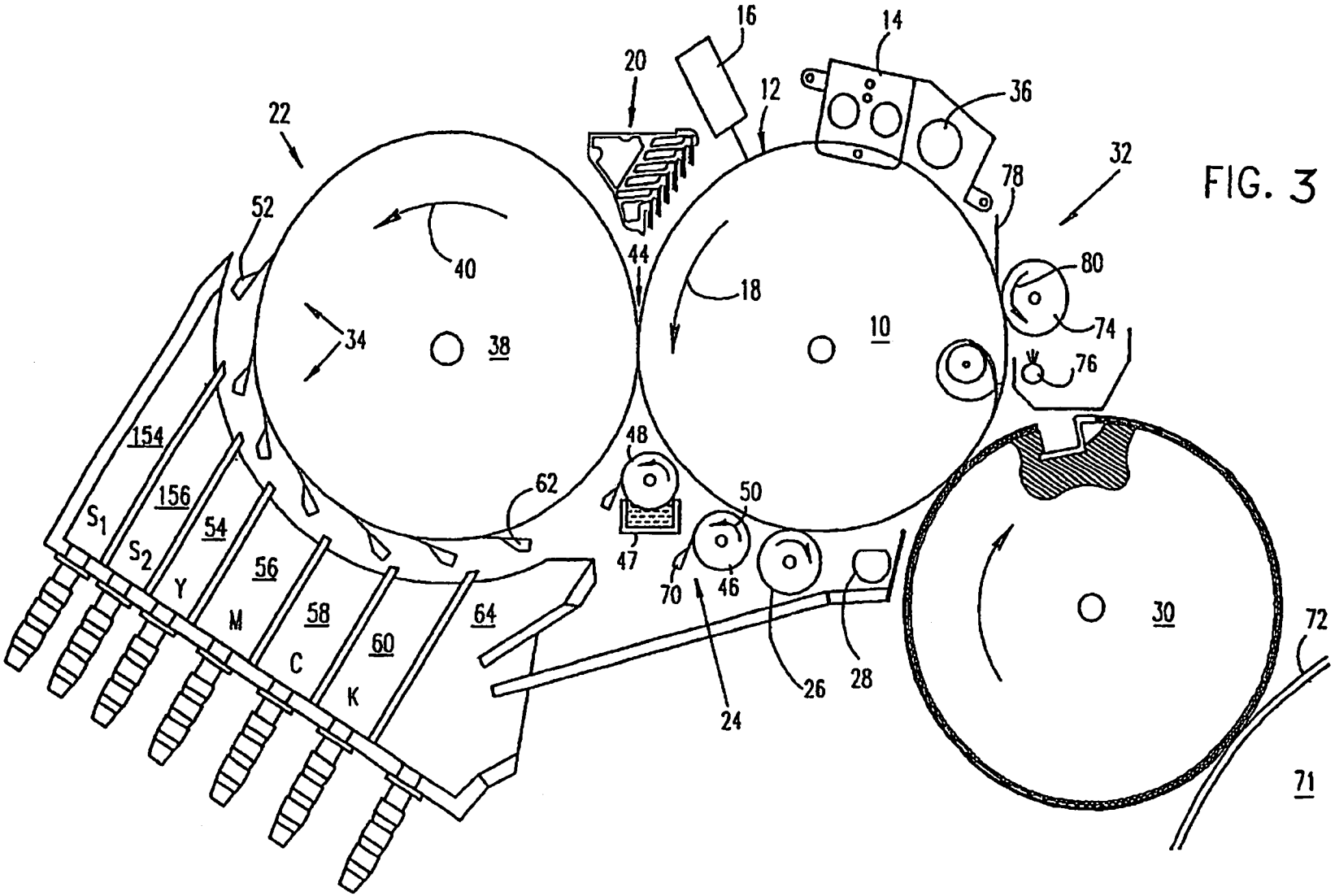

FIGS. 2 and 3 show a simplified schematic exposition of an exemplary one-shot printing system 11, in accordance with an embodiment of the invention. For convenience, the apparatus of FIGS. 2 and 3 is very simplified and does not include many of the details present in such apparatus, since the liquid toners of the invention are useful for a wide variety of designs for existing printers and since these existing devices need little or no substantive redesign. For details of some systems for which the invention is useful, the reader is referred to the extensive patent literature on the subject of liquid toner printing systems and especially to the patents and applications originally assigned to Indigo, N.V. and its predecessor Spectrum Sciences B.V. In general, the printing system is similar to that described in U.S. Pat. No. 5,915,152, the disclosure of which is incorporated herein by reference, since this publication describes, generally, an apparatus currently used for printing. However, as indicated above, other apparatus for producing toner images may be used, since, in general, the present invention is not specific to the method of forming the toner image before transfer to an intermediate transfer member.

As seen in FIGS. 2 and 3 system 11 comprises an imaging sheet, typically an organic photoreceptor 12, typically mounted on a rotating drum 10. Drum 10 is rotated about its axis by a motor or the like (not shown), in the direction of arrow 18, past a charging apparatus 14, preferably a corotron, scorotron or roller charger or other suitable charging apparatus as are known in the art and which is adapted to charge the surface of sheet photoreceptor 12. The image to be reproduced is focused by an imager 16 upon the charged photoreceptor 12 at least partially discharging the photoconductor in the areas struck by light, thereby forming the electrostatic latent image. Thus, the latent image normally includes image areas at a first electrical potential and background areas at another electrical potential.

Photoreceptor sheet 12 may use any suitable arrangement of layers of materials as is known in the art, however, as described and referenced in U.S. Pat. No. 5,915,152, certain of the layers are optionally removed from the ends of the sheet to facilitate its mounting on drum 10. Alternatively, photoreceptor 12 may be deposited on the drum 10 and may form a continuous surface. Furthermore, photoreceptor 12 may be a non-organic type photoconductor based, for example, on a compound of Selenium.

It should be noted that in other, alternative, embodiments of the invention, non-electrophotographic methods may be used for generating the electrostatic latent image. For example, the latent image may be a changeable or a permanent latent image generated by ionographic or other electrostatic image forming means or other methods for forming latent images, as known in the art, may be used.

In a exemplary embodiment of the present invention, imaging apparatus 16 is a modulated laser beam scanning apparatus, or other laser imaging apparatus such as is known in the art.

Also associated with drum 10 and photoreceptor sheet 12, in the exemplary embodiment, are a multicolor toner curtain applicator 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36. Some of these elements may be omitted or replaced by elements with similar functions, in some embodiments of the invention.

In the described embodiment, developing assembly 22 includes a development roller 38. Development roller 38 is generally spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

A multicolor toner curtain applicator 20, whose operation and structure is described in U.S. Pat. No. 5,915,152, is preferably fixedly mounted juxtaposed with a portion of the surface of photoreceptor 12, hereinafter referred to as an application region, upstream of a development region 44 between photoreceptor 12 and development roller 38. In accordance with the described embodiment, applicator 20 produces a continuous body of liquid toner, hereinafter referred to as a toner curtain, which propagates in the direction of the application region. For color imaging, a plurality of different color toner curtains are sequentially applied to the application region by toner applicator 20.

Optional color specific, cleaning blade assemblies 34, as known in the art, are operatively associated with developer roller 38 for separate removal of residual amounts of each colored toner raining thereon after development. Each of blade assemblies 34 is selectably brought into operative association with developer roller 38 when toner of a color corresponding thereto is supplied to the application region by toner curtain applicator 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 which serves to direct the toner removed by the cleaning blade assemblies 34 from the developer roller 38 to separate collection containers 54, 56, 58, 60, 154 and 156, one for each color toner, to prevent contamination of the various color toners by mixing therebetween. The different color toners collected by collection containers 54, 56, 58, 60, 154 and 156 are recycled to corresponding toner reservoirs 55, 57, 59, 61, 155 and 157. An optional final toner directing member 62 optionally always engages the developer roller 38 and the toner collected thereat is supplied into collection container 64 and thereafter to a carrier-liquid reservoir 65 via a separator 66 which is operative to separate relatively clean carrier liquid from the various colored toner particles. The separator 66 may be typically of the type described in U.S. Pat. No. 4,985,732, the disclosure of which is incorporated herein by reference.

In some embodiments of the invention, as described in PCT Publication WO 92/13297, the disclosure of which is incorporated herein by reference, where the imaging speed is very high, a background cleaning station 24, typically including a reverse roller 46 and a wetting roller 48, is optionally provided. Reverse roller 46 which rotates in a direction indicated by arrow 50 is preferably electrically biased to a potential intermediate that of the image and background areas of photoconductive drum 10, but different from that of the development roller. Reverse roller 46 is preferably spaced apart from photoreceptor sheet 12 thereby forming a gap therebetween which is typically 40 to 150 micrometers.

Wetting roller 48 is preferably partly immersed in a fluid bath 47, which preferably contains carrier liquid received from carrier liquid reservoir 65 via conduit 88. Wetting roller 48, which preferably rotates in the same sense as that of drum 10 and reverse roller 46, operates to wet photoreceptor sheet 12 with non-pigmented carrier liquid upstream of reverse roller 46. The liquid supplied by wetting roller 48 replaces the liquid removed from drum 10 by development assembly 22, thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via collection container 64 and separator 66.

Details of the operation of roller 46 and wetting roller 48 are described, in more detail, in U.S. Pat. No. 5,915,152. It should be understood that the apparatus shown in FIGS. 2 and 3 are not, per se new. Rather, the apparatus shown in FIGS. 2 and 3 is described as an example of an apparatus that can be used with the toners of the invention.

The apparatus embodied in reference numerals 46, 47, 48 and 70 is generally not required for low speed systems, but is preferably included in high speed systems.

Optionally, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is optionally charged to a potential of several hundred to a few thousand volts with the same polarity as the polarity of the charge on the toner particles.

Discharge device 28 is operative to flood sheet 12 with light which discharges the voltage remaining on sheet 12, mainly to reduce electrical breakdown and improve transfer of the image to intermediate transfer member 30. Operation of such a device in a write black system is described in U.S. Pat. No. 5,280,326, the disclosure of which is incorporated herein by reference.

FIGS. 2 and 3 further show that multicolor toner curtain applicator 20 receives separate supplies of colored toner typically from the six different reservoirs 55, 57, 59, 61, 155 and 157.

FIG. 1 shows the six different colored toner reservoirs 55, 57, 59, 61, 155 and 157, one of which typically contains a black toner, denoted K. The other reservoirs may contain any suitable standard or custom-selected colors, for example Yellow, Magenta and Cyan denoted Y, M and C, respectively, and other, special, colors denoted $S_1$ and $S_2$, respectively. Pumps 90, 92, 94, 96, 190 and 192 may be provided along respective supply conduits 170, 172, 174, 176, 180 and 182 for providing a desired amount of pressure to feed the colored toner to multicolor toner applicator 20. The use of six different reservoirs allows for custom colored tones in addition to the standard process colors. Alternatively, for standard 4-color imaging, toner applicator 20 is associated with only four different color toner reservoirs, typically containing the colors Yellow, Magenta, Cyan and Black.

Intermediate transfer member (ITM) 30 may be any suitable intermediate transfer member, for example, as described in U.S. Pat. Nos. 4,684,238 and 4,974,027 or in PCT Publication WO 90/04216, the disclosures of which are incorporated herein by reference. Alternatively, ITM 30 has a multi-layered transfer portion such as those described below or in U.S. Pat. Nos. 6,070,042; 5,754,931; 5,745,829; 5,592,269; 5,497,222; 5,335,054; 5,262,829; 5,089,856, 5,047,808, the disclosures of all of which are incorporated herein by reference. Member 30 is maintained at a suitable voltage and temperature for electrostatic transfer of the image thereto from the image bearing surface of photoreceptor 12. Intermediate transfer member 30 is preferably associated with a pressure roller 71 for transfer of the image onto a final substrate 72, such as paper, preferably by heat and pressure.

Cleaning apparatus 32 is operative to scrub clean the surface of photoreceptor 12 and preferably includes a cleaning roller 74, a sprayer 76 for spraying a non polar cleaning liquid, preferably chilled carrier liquid from reservoir 65, and a wiper blade 78 to complete the cleaning of the photoconductive surface. The sprayed carrier liquid assists in the scrubbing process and cools the photoreceptor surface. Cleaning roller 74 which may be formed of any synthetic resin known in the art for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with exemplary embodiments of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place.

In relevant embodiments of the invention, the toner used is a liquid toner comprising toner particles based on a polymer and having a carrier liquid that is solvated by the polymer at elevated temperatures.

A characteristic time for the above process is the "cycle time". This is the time that it takes the intermediate transfer member to make a complete rotation. Based on this time, the first layer transferred to the intermediate transfer member is on the heated intermediate transfer member for n−1 cycles, where u is the number of separations printed. Each subsequent separation is on the intermediate transfer member for 1 less cycle. In addition, each separation is typically on the intermediate transfer member for about an additional ¼-¾ of a cycle, depending on the relative position of first and second transfer around the intermediate transfer member. Thus, there is a difference of between n−¼ and n−¾ cycle times for dwell times of the first and last separations. For a process in which the impression rate is 8,000/hour the cycle time is about ½ second. Thus, for a multi-separation print, the first separation may be on the heated intermediate transfer member for several seconds. This time is long enough for there to be enough evaporation to cause substantial changes in the rheology (and/or other relevant properties of the toner particles in the separation.

Thus, for the same basic combination of polymer and carrier liquid, the rheology may change enough during the time that the first separation is on the intermediate transfer member, to bring its rheology out of a desirable range. On the other hand, if the toner (of the prior art) is constituted so that the first layer has a proper rheology after its long dwell, then the last layer (which is on the intermediate transfer member only a short time) may be out of the range of usable rheologies.

The phenomena of different rheologies of different toners is already known to the inventors. For example, standard toner utilizing carbon black as a pigment for black toner particles dries faster than other pigmented toners. Thus, in a one shot system utilizing black toner, the black separation is usually transferred last to the intermediate transfer member.

The solvation properties of polymers vary. Many polymers do not solvate the carrier liquid at all. Other polymers may give up their liquid relatively easily when heated, while others will retain the solvated liquid (and thus remain plasticized and/or tacky) for a longer period. Furthermore, the amount of solvation also depends on the type of liquid used.

According to one aspect of the invention, the polymer used for at least the first produced layer is different in constitution than that used for at least some of the subsequent layers.

In some embodiments a mixture of different polymers is used for the toner particles of at least some of the separations. For example, the first and last separations may comprise a different mixture of polymers, with some of the intermediate separations having the same rheology as the first and last separations or having intermediate rheological properties.

Table 1 shows different amounts of swelling for various polymer resins when heated together with different mineral oils that are compatible (depending on the percentages used) with known liquid toner imaging processes. Swelling is defined as the percentage increase in weight of a polymer when heated together with the liquid to a temperature at which is absorbs a large amount of the liquid and then allowed to cool to room temperature (25° C.). In other words, it is an indication of the amount of liquid that is "trapped" with the polymer, in the salvation process. In the following table, Bynel 2002 and 2022 (DuPont) Acid-Modified Ethylene Acrylates, with different Melt points (ASTM Test Methods DSC, D3418) and Melt indexes (ASTM Test method D1238, 190° C./2.16 Kg). The Bynel 2002 has a melt point of 91° C. Its Melt index is about 10 dg/min. The Bynel 2022 has a melt point of 87° C. and a melt index of 35. Primacor 5990I (DOW) is an ethylene acrylic acid copolymer having a melt index of 1300 (at 125° C.). Nucrels are ethylene acid/methacrylic acid copolymer resins. Nucrel 699 has a Melt flow index of 100 and a melting point of 94° C. Nucrel 599 has a melt flow index of 500 and a melting point of 98° C. Isopar H. Isopar L and Isopar M are aliphatic hydrocarbons sold by Exxon and Marcol 82 is a white mineral oil sold by Exxon. The relative evaporation times of the Isopars (compared to Diethylether) are H=65, L=150 and M=680. While these numbers indicate a low evaporation rate (high evaporation time), the differences in evaporation are significant in the context of a thin image on a heated intermediate transfer member. Marcol 82 is very stable with temperature It is noted that while Isopar H has in the past been used as a carrier liquid for liquid toners, it is generally not so used due to its high volatility. Marcol 82 is used as a minor ingredient in some liquid toners, but is not its very low volatility precludes the use of large amounts in toners. It is further noted that some of these polymers may be too soft to be used alone as toner polymers since they may have relatively low abrasion resistance. Thus, the toner materials are generally chosen based on other considerations in addition to the conditions described herein.

TABLE 1

| Polymer | Solvated Liquid | Swell in % W/W |
|---|---|---|
| Bynel 2022 | Isopar H | 52.9 |
| | Isopar L | 51.8 |
| | Isopar M | 47.4 |
| | Marcol 82 | 17.8 |
| Bynel 2002 | Isopar H | 39.6 |
| | Isopar L | 38.6 |
| | Isopar M | 37.1 |
| | Marcol 82 | 13.8 |
| Primacor 5990 | Isopar H | 39.0 |
| | Isopar L | 37.1 |
| | Isopar M | 34.5 |
| | Marcol 82 | 7.3 |
| Nucrel 599 | Isopar H | 28.5 |
| | Isopar L | 27.6 |
| | Isopar M | 21.7 |
| | Marcol 82 | 5.9 |
| Nucrel 699 | Isopar H | 22.2 |
| | Isopar L | 21.7 |
| | Isopar M | 21.6 |
| | Marcol 82 | 5.7 |

It is apparent that the Bynels and the Primacor resins have a high absorption of all of the Isopars (more than 34%) and that the Nucrels have a lower absorption of the Isopars (less than 28.5%). The present inventors have found that when a mixture of Bynel 2002 and Nucrel 699 are used as the polymer base of toner particles in a liquid toner, the second transfer of separations that are transferred first to the intermediate transfer member is greatly improved over the transfer for standard toners based on Nucrel 699. The amount of Bynel 2002 that is needed for complete transfer of the separation varies depending on a large number of factors, for example, the pigment used, the dwell time, the number of separations, the temperature of the intermediate transfer member and the amount of liquid that is removed before first transfer. However, once the conditions are set, a near optimum set of toners can be achieved with a reasonable amount of experimentation. The polymer used can be between 0-100% by weight for each of the materials, depending on the order of printing of the particular separation. In an embodiment of the invention, at least one of the colors has a large proportion of Bynel 2002 (50-100%) and a second color (to be transferred to the intermediate transfer member later) has a low proportion (0-30%). Furthermore, the proportion of Bynel may be increased (or decreased) for those colors in which the pigments affect the rheology adversely, for example by absorbing the liquid or by otherwise increasing (or decreasing) the hot viscosity of the toner particles on the intermediate transfer member at second transfer. Although the above discussion is centered on combinations of Bynel 2002 and Nucrel 699, other materials, both shown and not shown are believed to be usable instead of these materials, utilizing the teaching of the invention. For example, Bynel 2022 gives similar results.

In particular, it is believed that utilizing different mixtures of polymers as the base for a set of colored toners for a one-shot transfer system can be useful if the mixtures are chosen such that the spread in rheologic characteristics of the images formed on the intermediate transfer member are reduced at the time of second transfer.

In accordance with an exemplary embodiment of the invention, 600 grams of a polymer, as described below, is mixed together with 1,400 grams of Isopar L at 130° C. in a Ross Double Planetary mixer for 1 hour at a v=2 speed setting, followed by 2 hours at 130° C. at a v=5 setting. The heating is then switched off and the material is allowed to cool while being mixed at a speed setting of v=4 for 1 hour followed by continued cooling at v=2 until the temperature reaches 30° C.

The resulting material comprises a mixture of Isopar L and polymer with solvated Isopar that is held within the polymer material.

909.8 grams of the solvated polymer is charged, together with 85.7 grams of Hostaperm Yellow 60L and Novoperm Yellow 5GD70 (Clarint) and 1.035 g of aluminum sterate (a charge improvement additive), into an S-1 atrittor (Union Process) filled with 3/16" chrome steel balls. The resulting mixture is ground for 3 hours at 55° C. followed by grinding at 17 hours at 40° C. to produce a yellow liquid toner concentrate having a non-volatile solids content of 18%, by weight, and an average particle size of 7 micrometers as measured by a Coulter Particle Size Analyzer. Other colored toners are produced in a similar manner by replacing the Yellow pigment by pigments having other colors, as is well known in the art. Additional Isopar L is added to reduce the non-volatile solids concentration to 2% and charge director, as known in the art is added. About 2% Marcol 82 may also be added.

In some embodiments of the invention, Nucrel 699 is used as the polymer for at least some of the colored toners. In others a mixture of one of the Nucrels and Bynel 2022 or Bynel 2002 or Primacor 5990 or other mixtures including having one or more of the characteristics described above, is used. In some embodiments of the invention, one of the components has a swell over 30% in the liquid used in the first stage of the processes described above and a second component has a swell of under 30%. Alternatively or additionally, the swell ratios should be different by a factor of more than about 1.5 to 1. However, use of higher volatility liquids (such as Isopar H) for the first stage of the process may be less desirable since the Isopar H may evaporate during the time the image is on the intermediate transfer member.

Use of different toner polymer blends for the toner particles allows for adjusting the mounts of hydrocarbon liquid trapped in the polymer for the different colors and allows for adjustment of the rheological characteristics of the toner images on the intermediate transfer member to compensate for one or more of differing effects of time of the image on the heated intermediate member (and thus difference in the amount of liquid that is evaporated), the effects of different pigments on the rheology of the toner particles. At present it is believed that best results (and a widest operating window) results when the rheology of the toner images is the same for all the separations at second transfer.

Alternatively or additionally, in some embodiments of the invention, a less volatile hydrocarbon liquid is used for the preparation of the solvated polymer than for the bulk of the carrier liquid for those toners that are printed first. Thus in the first stage of preparation described above, the Isopar L may be replaced by Isopar M. Some of the hydrocarbon liquid in the second stage may also be Isopar M. Isopar M has a lower evaporation than Isopar L. Optionally, the volatility of the solvated liquid in the first stage should be less than 4 and the volatility of the bulk of the carrier liquid in the final liquid toner should be more than 4. Optionally, the ratios of the volatilities should be at least 1.5:1. Optionally it is more than 2 or 3:1. Optionally, it is 4:1. However, it should be understood that the amount of swelling should be high enough so that there is substantial salvation. Generally, it is believed that the combination of liquid and polymer used in the first processing stage should result in swelling of at least 20%, optionally more than 25 or 30%.

A number of combinations are thus seen to be especially desirable. For example, Isopar L can be used with varying combinations of Bynels or Primacor and Nucrels. The toner particles used for the first separation transferred to the intermediate transfer member would have a relatively high percentage of Bynel or Primacor (or be entirely of these materials) and the toner particles used in a later separation would have a larger percentage of the Nucrels (or be entirely of these materials.

Alternatively, toner particles in all the separations could be made of the same material, such as Nucrel 699 and the first stage of manufacture of the toner for the first separation could use Isopar M and at least one of the later separations could use Isopar L. In some embodiments the first transferred separation could use both a higher percentage of Bynel or Primacor and Isopar M in the first stage of manufacture and a later separation could be based mostly or completely on a Nucrel and Isopar L. Other combinations will occur to a person of skill in the art.

Alternatively or additionally an additional plasticizer, over an above the liquid hydrocarbon that is solvated by the toner polymer is used in the formulation of some or an of the toner particles. In general, a larger amount of plasticizer is used in some of the colored toners than in others, with the larger amounts being used in those toners that are transferred first to the intermediate transfer member or in those toners that have a high viscosity for other reasons (such as black toners pigmented with carbon black. Optionally, no plasticizer is used in one or more of the colors in the set. Useful plasticizers are believed to include Di Butyl phtalate, Acetyl tri-ethyl citrate and Acetyl tri-butyl citrate. Other plasticizers may also be used.

The invention has been described in the context of a best mode for carrying it out. It should be understood that not all the features shown in any one drawing may be present in an actual device, in accordance with some embodiments of the invention and that some features described with respect to one figure may be in another embodiment as well. Furthermore, variations on the methods and apparatus shown are included within the scope of the invention, which is limited only by the claims. Such variations may include use of a computer program to carry out some of the methods, the replacement of hardware by software, software by hardware and the replacement of hardware or software by firmware.

As used herein, the terms "have", "include" and "comprise" or their conjugates, as used herein mean "including but not limited to".

The invention claimed is:

1. A set of at least two liquid toners for printing multi-color images, each said toner having a different color, each said toner comprising:

a carrier liquid, and toner particles comprising a pigmented polymer of a given color, different from the color of pigmented particles in other toners in the set, wherein said polymer particles in a first liquid toner of said set and in at least one of the other liquid toners have different compositions, aside from colorants, the differences in composition including at least one of different polymers or blends of polymers, different amounts or types of plasticizers, different amounts of solvated liquid and different compositions of solvated liquid, and wherein the pigmented polymer is part of a solvanted liquid, and the carrier liquid is the same as the solvated liquid.

2. A set of liquid toners according to claim 1 wherein the carrier liquid is a liquid hydrocarbon.

3. A set of liquid toners according to claim 1 wherein the pigmented polymer is part of a solvated liquid, and the solvated liquid is a liquid hydrocarbon.

4. A set of liquid toners according to claim 1 wherein said first and at least one additional liquid toners have substantially similar characteristics at 25° C.

5. A set of liquid toners according to claim 1 wherein said polymer particles pigmented polymer particles solvate said carrier liquid in said first and at least one additional liquid toner at 75° C.

6. A set of liquid toners according to claim 1 wherein at least said first liquid toner comprises a plasticizer for said toner particles, said plasticizer being additional to or different from in amount or type from any plasticizer that may be present in said at least one additional liquid toner.

7. A set of liquid toners according to claim 6 wherein said plasticizer comprises Di Butyl phtalate.

8. A set of liquid toners according to claim 6 wherein said plasticizer comprises Acetyl tri-ethyl citrate.

9. A set of liquid toners according to claim 6 wherein said plasticizer comprises Acetyl tri-butyl citrate.

10. A set of liquid toners according to claim 1 wherein said polymer particles in said first liquid toner comprise a different polymer or mixture of polymers than do the polymer particles in said at least one additional toner.

11. A set of liquid toners according to claim 10 wherein said polymers are different in that the polymer of one of the particles is formed of a mixture of polymers said mixture comprising a polymer comprised in the other particles and at least one additional polymer not comprised in the one particle.

12. A set of liquid toners according to claim 10 wherein said polymers are different in that the polymer of the particles are formed of a mixture of polymers the proportion of polymers in said mixture being different for the respective particles.

13. A set of liquid toners according to claim 10 wherein said polymers are different.

14. A set of liquid toners according to claim 1 wherein one of the polymers is an ethylene acid/methacrylic acid copolymer.

15. A set of liquid toners according to claim 1 wherein one of the polymers is an Acid-Modified Ethylene Acrylate.

16. A set of liquid toners according to claim 1 wherein one of the polymers is an ethylene acrylic acid copolymer.

17. A set of liquid toners according to claim 1 wherein the polymer particles are formed in a process in which the polymer of the particles is heated with and plasticized by a liquid, some of which remains solvated by the polymer after cooling the particles and wherein the proportionate amount or composition of said remaining solvated liquid is different for the particles in the first and at least one additional toner.

18. A set of liquid toners according to claim 17 wherein said proportionate amount is different.

19. A set of liquid toners according to claim 18 wherein the proportion by weight of liquid in the first toner particles is over 30% by weight of polymer.

20. A set of liquid toners according to claim 18 wherein the proportion by weight of liquid in the first toner particles is over 35% by weight of polymer.

21. A set of liquid toners according to claim 18 wherein the proportion by weight of liquid in the toner particles of at least one additional toner is less than 30% by weight of polymer.

22. A set of liquid toners according to claim 18 wherein the proportion by weight of liquid in the toner particles of at least one additional toner is less than 25%.

23. A set of liquid toners according to claim 17 wherein said composition is different.

24. A set of liquid toners according to claim 23 wherein the liquid solvated in the toner particles of the first toner comprises liquid having an evaporation time compared to Diethylether of more than 150.

25. A set of liquid toners according to claim 23 wherein the liquid solvated in the toner particles of the first toner comprises liquid having an evaporation time compared to Diethylether of more than 250.

26. A set of liquid toners according to claim 23 wherein the liquid solvated in the toner particles of at least one additional toner comprises liquid having an evaporation time compared to Diethylether of less than 150.

27. A set of liquid toners according to claim 23 wherein the ratio of evaporation times of the liquids solvated in the first and second toner particles is at least 2:1.

28. A set of liquid toners according to claim 23 wherein the ratio of evaporation times of the liquids solvated in the first and second toner particles is at least 3:1.

29. A set of liquid toners according to claim 23 wherein the ratio of evaporation times of the liquids solvated in the first and second toner particles is at least 4:1.

30. A set of liquid toners according to claim 1 wherein said carrier liquid used in said first and at least one additional toner is different or comprises a mixture of different carrier liquids or a mixture of the same carrier liquids in different proportions.

31. A set of liquid toners according to claim 1 wherein said toner particles in said first and at least one other liquid toners have different characteristics including at least one of rheology, tackiness and cohesiveness, for at least some of the different colored liquid toners in the set of liquid toners.

32. A set of liquid toners according to claim 31 wherein said toners have said different characteristics at elevated temperatures.

33. A set of liquid toners according to claim 1 wherein said polymer particles solvate said carrier liquid at elevated temperatures, suitable for fusing and fixing the toner to a substrate.

34. A set of liquid toners according to claim 33 wherein a first liquid toner at a first, higher solids concentration has substantially the same characteristic as another liquid toner of the set at a second lower solids concentration at an elevated temperature at which the toner particles solvate the carrier liquid.

35. A set of liquid toners according to claim 1 wherein said carrier liquid is different for at least two liquid toners of the set of liquid toners.

36. A set of liquid toners according to claim 35 wherein the carrier liquid in a first member of the set comprises a first carrier liquid component not present in at least one other liquid toner of the set, said first carrier liquid component having a slower evaporation at high temperatures than carrier liquid components present in both liquid toners.

37. A set of liquid toners according to claim 35 wherein the carrier liquid in a first member of the set comprises a first carrier liquid component present in at least one other liquid toner of the set in a higher proportion than in at least one other liquid toner of the set, said first carrier liquid component having a slower evaporation at high temperatures than other carrier liquid components present in both liquid toners.

38. A set of liquid toners according to claim 1 wherein the liquid toners comprise at least cyan, magenta and yellow toners.

39. A set of liquid toners according to claim 1 the liquid toners comprise a black toner.

40. A set of liquid toners according to claim 1 wherein the liquid toners comprise one or more of violet, orange and green toners.

41. A set of at least two liquid toners for printing multicolor images, each said toner having a different color, each said toner comprising:

a carrier liquid, and toner particles comprising a pigmented polymer of a given color, different from the color of pigmented particles in other toners in the set, wherein said polymer particles in a first liquid toner of said set and in at least one of the other liquid toners have different compositions, aside from colorants, the differences in composition including at least one of different polymers or blends of polymers, different amounts or types of plasticizers, different amounts of solvated liquid or different compositions of solvated liquid, and wherein said polymer particles in said first liquid toner comprise a different polymer or mixture of polymers than the polymer particles in said at least one additional toner, said polymers being different in that the polymer of one of the particles is formed of a mixture of polymers comprising a polymer from one of the other particles and at least one additional polymer not present in the one of the other particles.

42. A set of liquid toners according to claim 41 wherein one of the polymers is an ethylene acid/methacrylic acid copolymer.

43. A set of liquid toners according to claim 41 wherein one of the polymers is an acid-modified ethylene acrylate.

44. A set of liquid toners according to claim 41 wherein one of the polymers is an ethylene acrylic acid copolymer.

* * * * *

UNITED STATES PATENT AND TRADEMARK OFFICE

CERTIFICATE OF CORRECTION

PATENT NO. : 8,685,610 B2
APPLICATION NO. : 12/417538
DATED : April 1, 2014
INVENTOR(S) : Galia Golodetz et al.

It is certified that error appears in the above-identified patent and that said Letters Patent is hereby corrected as shown below:

In the Claims

In column 15, line 60, in Claim 1, delete "solvanted" and insert -- solvated --, therefor.

In column 16, line 15, in Claim 7, delete "phtalate." and insert -- phthalate. --, therefor.

Signed and Sealed this
Twenty-second Day of July, 2014

Michelle K. Lee

Michelle K. Lee
*Deputy Director of the United States Patent and Trademark Office*